US011171452B2

(12) United States Patent
Saito

(10) Patent No.: US 11,171,452 B2
(45) Date of Patent: Nov. 9, 2021

(54) CONNECTOR

(71) Applicant: YAZAKI CORPORATION, Tokyo (JP)

(72) Inventor: Akihiro Saito, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/716,439

(22) Filed: Dec. 16, 2019

(65) Prior Publication Data

US 2020/0212627 A1 Jul. 2, 2020

(30) Foreign Application Priority Data

Dec. 27, 2018 (JP) ..... JP2018-245611

(51) Int. Cl.
*H01R 13/639* (2006.01)
*H01R 13/627* (2006.01)

(52) U.S. Cl.
CPC ..... *H01R 13/639* (2013.01); *H01R 13/6272* (2013.01)

(58) Field of Classification Search
None
See application file for complete search history.

(56) References Cited

U.S. PATENT DOCUMENTS 6,234,826 B1 * 5/2001 Wilber ..... H01R 13/4368 439/352
6,824,421 B2 * 11/2004 Oka ..... H01R 13/6272 439/489
8,926,356 B2 * 1/2015 Kon ..... H01R 13/6272 439/352
2003/0096527 A1 * 5/2003 Greiner ..... H01R 13/6272 439/352
2004/0067676 A1 4/2004 Nimura

FOREIGN PATENT DOCUMENTS

JP 2002-8779 A 1/2002
JP 2004-103551 A 4/2004

* cited by examiner

*Primary Examiner* — Felix O Figueroa
(74) *Attorney, Agent, or Firm* — Kenealy Vaidya LLP

(57) ABSTRACT

A connector includes a housing fitted into a mating side housing, a locking arm including a locking portion, and a slider. The locking arm is connected to the housing and extends toward a rear end and along a fitting direction into the mating side housing. The locking arm is configured to be restored after bending in a lock release direction and the locking portion is configured to be engaged with an engagement portion of the mating side housing to lock the mating side housing and the housing, when the housing is being fitted into the mating side housing. A slider is slidably attached to the housing between a main locking position on a bending end side of the locking arm and a temporary locking position deviating from the main locking position.

10 Claims, 8 Drawing Sheets

CONNECTOR

CROSS REFERENCE TO RELATED APPLICATIONS

This application claims priority from Japanese Patent Application No. 2018-245611 filed on Dec. 27, 2018, the entire contents of which are incorporated herein by reference.

BACKGROUND OF THE INVENTION

Field of the Invention

The present invention relates to a connector.

Description of Related Art

A connector to be fitted into a mating side connector includes a lock operation member (locking arm) that locks a lock projection formed on a housing of the mating side connector, and a connector position assurance mechanism that regulates a bending operation of the lock operation member locking the lock projection to maintain a locked state by advancing a release operation member (slider) assembled to be able to advance or retreat relative to a housing (for example, Patent Literature 1: JP-A-2002-8779).

[Patent Literature 1] JP-A-2002-8779

In the connector including the connector position assurance mechanism that regulates the release operation of the lock as described above, the release operation member may be unintentionally advanced before fitting with the mating side connector. Then, the lock operation member does not bend, and fitting work cannot be performed when the connector is fitted with the mating side connector. When the fitting work is forcibly performed on the mating side connector in this state, the lock operation member, the release operation member, and the like may be damaged.

In this case, it is considered that when the connector is fitted with the mating side connector, a mechanism that pushes back the advancing release operation member or the like is provided by being added to the mating side connector, but an increase in cost of the mating side connector is resulted.

SUMMARY

One or more embodiments provide a connector that can cause a connector position assurance mechanism to smoothly function while reducing an increase in cost.

In an aspect (1), one or more embodiments provide a connector including a housing fitted into a mating side housing, a locking arm including a locking portion, and a slider. The locking arm is connected to the housing and extends toward a rear end and along a fitting direction into the mating side housing. The locking arm is configured to be restored after bending in a lock release direction and the locking portion is configured to be engaged with an engagement portion of the mating side housing to lock the mating side housing and the housing, when the housing is being fitted into the mating side housing. A slider is slidably attached to the housing between a main locking position on a bending end side of the locking arm and a temporary locking position deviating from the main locking position. The slider is configured to be moved from the temporary locking position to the main locking position, so as to regulate bending of the locking arm in the lock release direction. At least one of the slider and the locking arm includes a push-back inclined surface inclined in a main locking position side and toward a bending direction in the lock release direction of the locking arm. When the slider is disposed at a position deviating from the temporary locking position, the locking arm is bent in the lock release direction and is in contact with the slider, and the slider is pushed back in a direction away from the main locking position by the push-back inclined surface.

According to the aspect (1), when the slider is slid from the temporary locking position to the main locking position when the housing is fitted into the mating side housing, the bending of the locking arm is regulated by the slider. Therefore, a fitting state between the housings is reliably maintained by the slider.

Further, when the housing is fitted into the mating side housing in a state in which the slider deviates from the temporary locking position and moves toward the main locking position, the locking arm bends, so that the slider is pushed back in a direction away from the main locking position by the push-back inclined surface.

Therefore, even when the slider moves from the temporary locking position toward the main locking position unintentionally, it is possible to reduce such a malfunction that the bending of the locking arm is regulated by the slider and the fitting work cannot be done, and such a malfunction that the locking portion of the locking arm and the engagement portion of the mating side housing are damaged.

That is, it is possible to smoothly function the connector position assurance mechanism by the slider while reducing the increase in cost by providing a mechanism that pushes back the slider disposed at a position away from the temporary locking position before fitting between the housings.

In an aspect (2), the slider includes an abutting surface orthogonal to the bending direction of the locking arm. The locking arm is configured to be abutted on the abutting surface of the slider disposed at the main locking position, so as to regulate bending in the lock release direction.

According to the aspect (2), when the slider is disposed at the main locking position when the housing is fitted into the mating side housing, the locking arm is abutted on the abutting surface to regulate the bending. Therefore, a fitting state between the housings is reliably maintained by the slider.

In an aspect (3), a main locking portion locking the slider at the main locking position and a temporary locking portion locking the slider at the temporary locking position are disposed between the housing and the slider.

According to the aspect (3), since the slider is locked at the main locking position by the main locking portion, it is possible to further reliably maintain the fitting state between the housings by the slider. Since the slider is locked at the temporary locking position by the temporary locking portion, it is possible to reduce the slider from being moved toward the main locking position before fitting between the housings.

According to one or more embodiments, it is possible to provide a connector capable of smoothly functioning a connector position assurance mechanism while reducing an increase in cost.

The present invention has been described briefly above. Further, detail of the present invention will be further clarified by reading a mode for carrying out the invention to be described below with reference to the attached drawings.

BRIEF DESCRIPTION OF THE DRAWINGS

FIG. 8A is a sectional view in the slide direction of the slider when the slider is disposed at a position deviating from the temporary locking position. FIG. 8B is a sectional view in the slide direction of the slider when the slider is pushed back in a direction away from the main locking position by the push-back inclined surface.

DETAILED DESCRIPTION

Hereinafter, an embodiment according to the present invention will be described with reference to the drawings.

Figure 1:
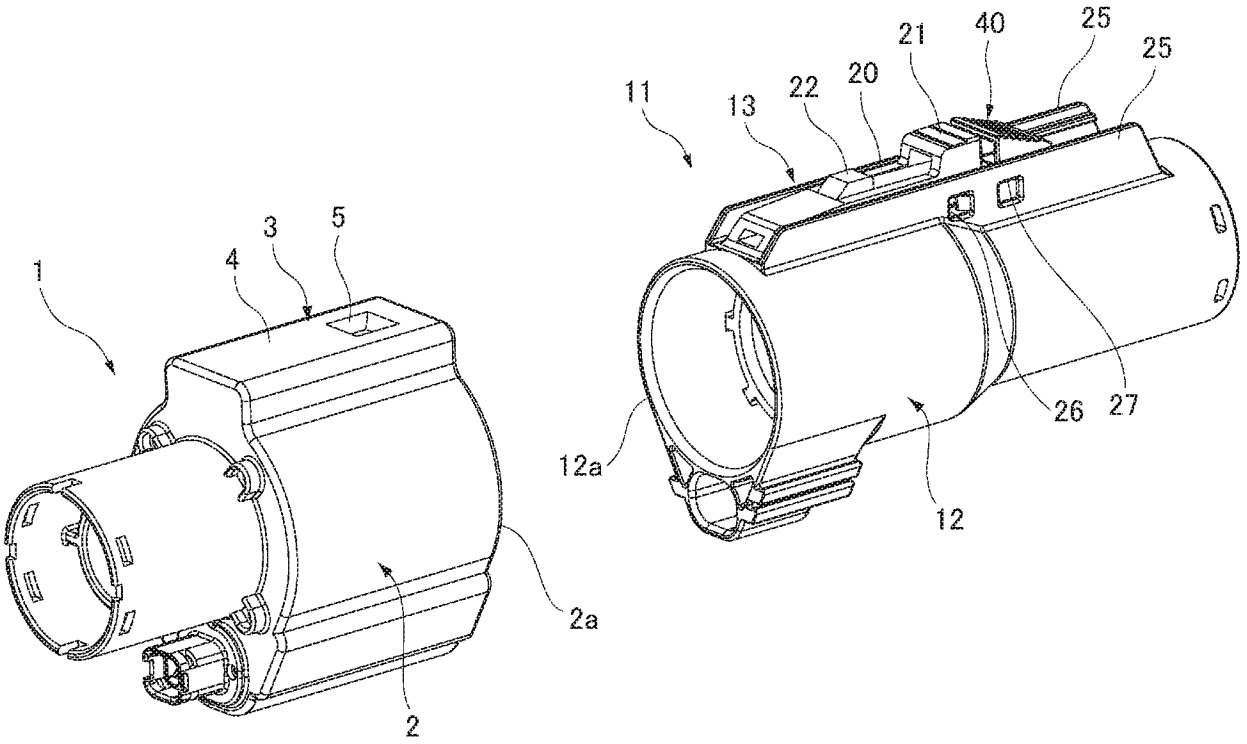
FIG. 1 is a perspective view of a connector according to an embodiment of the present invention and a mating side connector.
Figure 2:
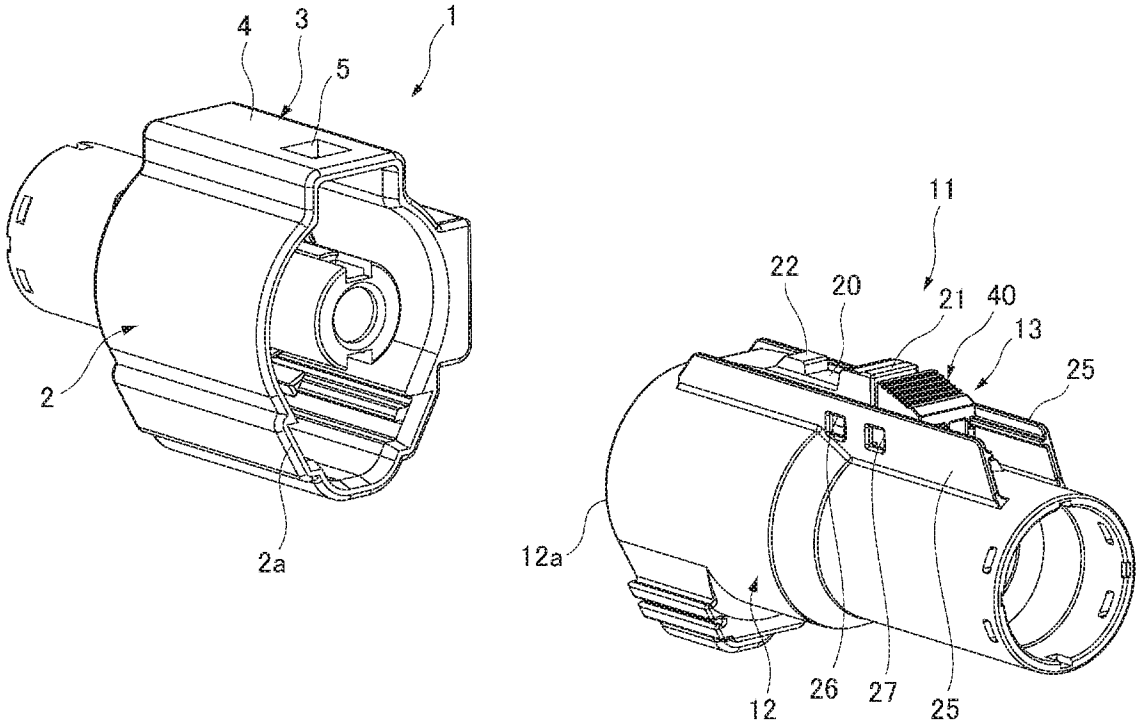
FIG. 2 is a perspective view of the connector according to the present embodiment and the mating side connector.

FIG. 1 and FIG. 2 are perspective views of a connector 11 according to an embodiment of the present invention and a mating side connector 1.

As shown in FIG. 1 and FIG. 2, the connector 11 according to an embodiment of the present invention includes a mating side housing 12 that is fitted into a mating side housing 2 of the mating side connector 1. The connector 11 has a connector position assurance (CPA) mechanism function that assures a fitting state with the mating side connector 1.

The connector 11 has a connecting portion 12*a* on the housing 12, and is joined to the mating side connector 1 by fitting the connecting portion 12*a* into a fitting portion 2*a* formed on a tubular shape of the mating side housing 2. Accordingly, terminals (not shown) provided on the housing 12 and the mating side housing 2 are electrically connected to each other.

The mating side connector 1 includes a fitting engagement portion 3 on a fitting portion 2*a* of the mating side housing 2. The fitting engagement portion 3 is formed in a U shape projecting toward an outer peripheral side in a sectional view, and an engagement hole (engagement portion) 5 is formed on a top plate portion 4 of the fitting engagement portion 3.

The housing 12 is formed of an insulating synthetic resin, and thereof includes a lock mechanism 13 on the connection portion 12*a*. The lock mechanism 13 locks the engagement hole 5 formed on the fitting engagement portion 3 of the mating side housing 2 by fitting the housing 12 of the connector 11 into the mating side housing 2 of the mating side connector 1, and maintains a state in which the housing 12 and the mating side housing 2 are fitted with each other.

Figure 3:
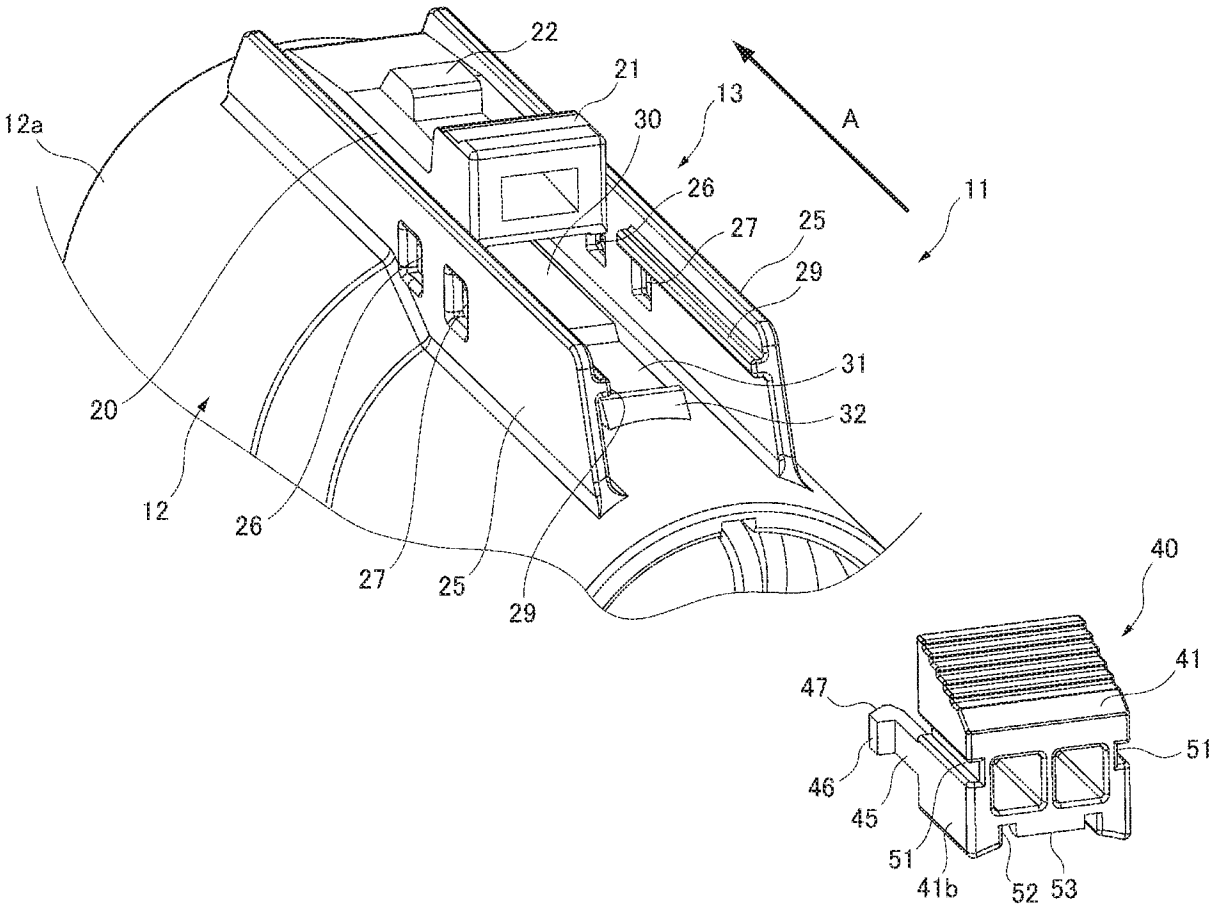
FIG. 3 is an exploded perspective view of a connector position assurance mechanism provided on the connector.
Figure 4:
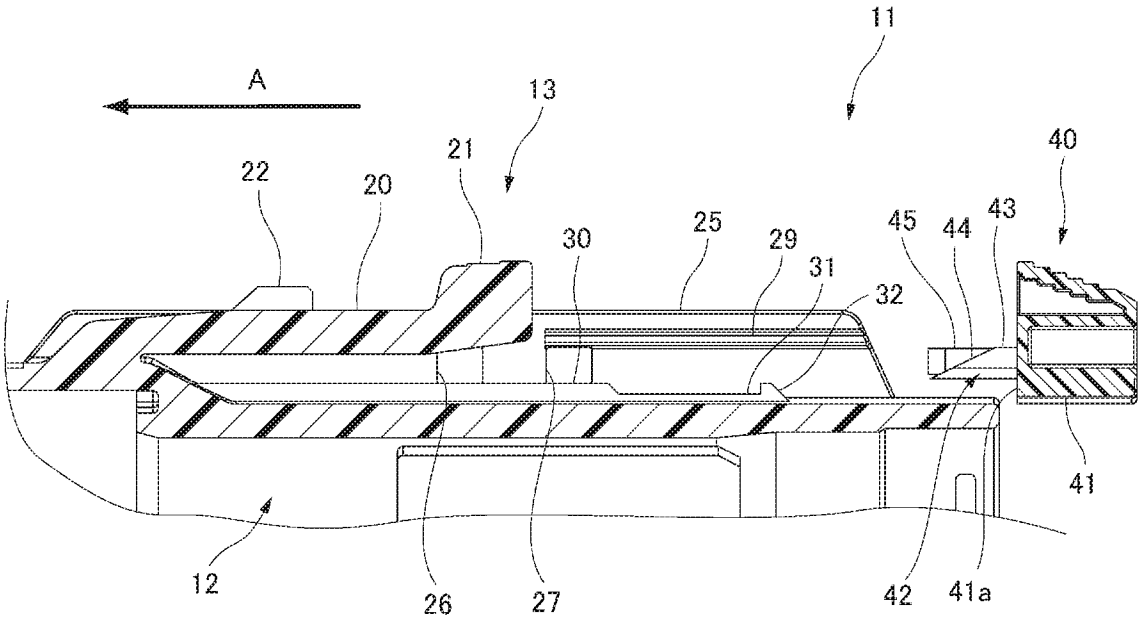
FIG. 4 is a sectional view of a slider in the connector position assurance mechanism provided on the connector in a slide direction.

FIG. 3 is an exploded perspective view of a connector position assurance mechanism provided on the connector 11. FIG. 4 is a sectional view of a slider 40 in the connector position assurance mechanism provided on the connector 11 in a slide direction.

As shown in FIG. 3 and FIG. 4, the lock mechanism 13 of the connector 11 includes a locking arm 20 and the slider 40.

The locking arm 20 is connected to the housing 12 and extends to a rear end side of the housing 12 in a fitting direction A to the mating side housing 2. A rear end of the cantilever-shaped locking arm 20 is a free end, and a pressing portion 21 projecting upward is formed at the rear end which is the free end. The locking arm 20 is supported by opening a gap with respect to the housing 12. A locking claw (locking portion) 22 projecting upward is formed on a middle portion of the locking arm 20 in a longitudinal direction. The locking claw 22 is engaged with the engagement hole 5 of the mating side housing 2 to lock the mating side housing 2 with the housing 12 in a fitting state.

Support walls 25 are formed on both sides of the locking arm 20 on the housing 12. The support walls 25 are erected parallel to each other along the locking arm 20. A locking hole (main locking portion) 26 and a temporary locking hole (temporary locking portion) 27 are formed on the support walls 25. The locking hole 26 is formed in a lower position at the rear end of the locking arm 20, and the temporary locking hole 27 is formed in a rear position in the fitting direction A with respect to the locking hole 26. Guide rail portions 29 extending in the fitting direction A are formed on surfaces of the support walls 25 that face each other.

A protruding portion 30 extending in the fitting direction A is formed in a position facing the locking arm 20 on the housing 12. An engagement recess 31 is formed on the rear side in the fitting direction A on the protruding portion 30. A tapered surface 32 inclined upward toward a front in the fitting direction A is formed at a rear end of the protruding portion 30.

Figure 5:
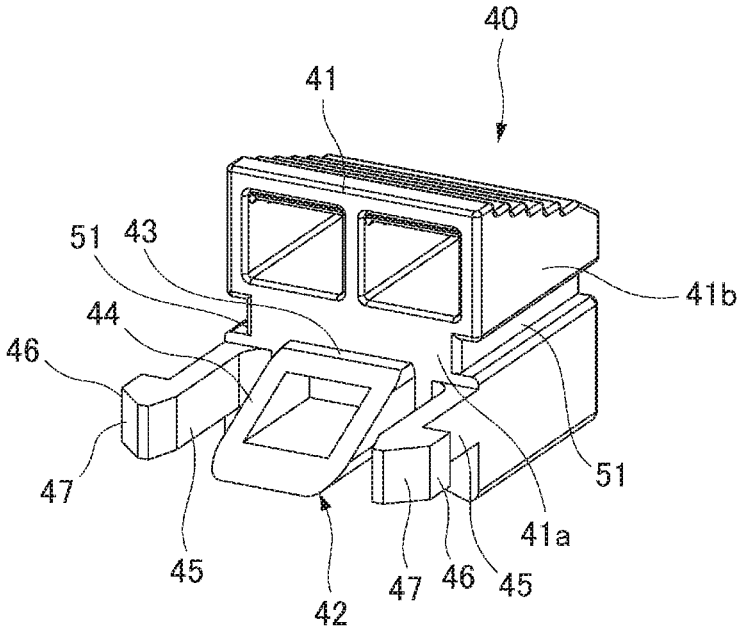
FIG. 5 is a perspective view of the slider of the connector position assurance mechanism.

FIG. 5 is a perspective view of the slider 40 of a connector position assurance mechanism.

As shown in FIG. 5, the slider 40 includes a slider body 41 formed in a block shape. The slider 40 is formed of a synthetic resin, and therefore a bending regulation portion 42 is formed on a lower side of a front surface 41*a* of the slider body 41. An abutting surface 43 and a push-back inclined surface 44 are formed on the bending regulation portion 42. The abutting surface 43 is orthogonal to a bending direction in which the locking arm 20 is pressed at the pressing portion 21, and is formed on an upper portion of a root part of the bending regulation portion 42. The push-back inclined surface 44 is formed on an upper side of a front side of the abutting surface 43 of the bending regulation portion 42. The push-back inclined surface 44 is an inclined surface inclined to a main locking position side to be described later toward the bending direction in which the locking arm 20 is pressed at the pressing portion 21.

Locking arms 45 projecting forward are formed on both side portions of the slider body 41 in the slider 40. Locking claws 46 projecting to opposite sides of each other are formed on tips of the locking arms 45. Guide surfaces 47 inclined backward toward the projecting directions of the locking claws 46 are formed at the tips of the locking arms 45.

Guide grooves 51 are formed on both side surfaces 41*b* of the slider body 41 in a front-rear direction. A guide recess 52 is formed on a lower portion of the slider body 41, and a locking protrusion 53 is formed on the guide recess 52 on a rear end side of the slider body 41 (see FIG. 3).

Figure 6:
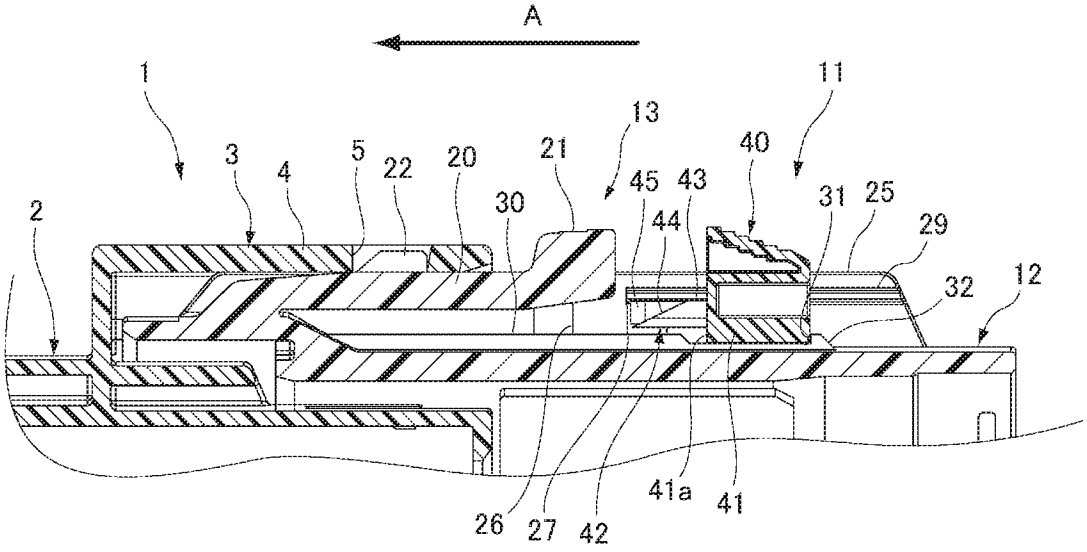
FIG. 6 is a sectional view of the slider in the slide direction when the slider on the connector fitted into the mating side connector is disposed at a temporary locking position.

FIG. 6 is a sectional view of the slider 40 in the slide direction when the slider 40 on the connector 11 fitted into the mating side connector 1 is disposed at a temporary locking position.

As shown in FIG. 6, the slider 40 is equipped from the rear side between the support walls 25 of the housing 12. Specifically, the guide rail portions 29 of the support walls 25 are engaged with the guide grooves 51 formed on the slider body 41 of the slider 40, and the slider 40 is pushed in toward a front side in the fitting direction A. Then, the locking protrusion 53 of the slider body 41 slides and rides over the tapered surface 32 and enters the engagement recess 31. Accordingly, the slider 40 is supported by the housing 12 to be slidable within a movable range of the engagement protrusion 53 in the engagement recess 31.

When the locking claws 46 of the locking arms 45 of the slider 40 equipped to the housing 12 enters the temporary locking holes 27, the temporary locking holes 27 of the housing 12 are locked by the locking arms 45, and movement of the slider 40 is regulated. In the slider 40, a main locking position at which the locking arm 45 locks the temporary locking hole 27 is set as a temporary locking position. Then, when the slider 40 is disposed at the temporary locking position, the locking arm 20 is enabled to bend toward the housing 12 (bend in a lock release direction).

Figure 7:
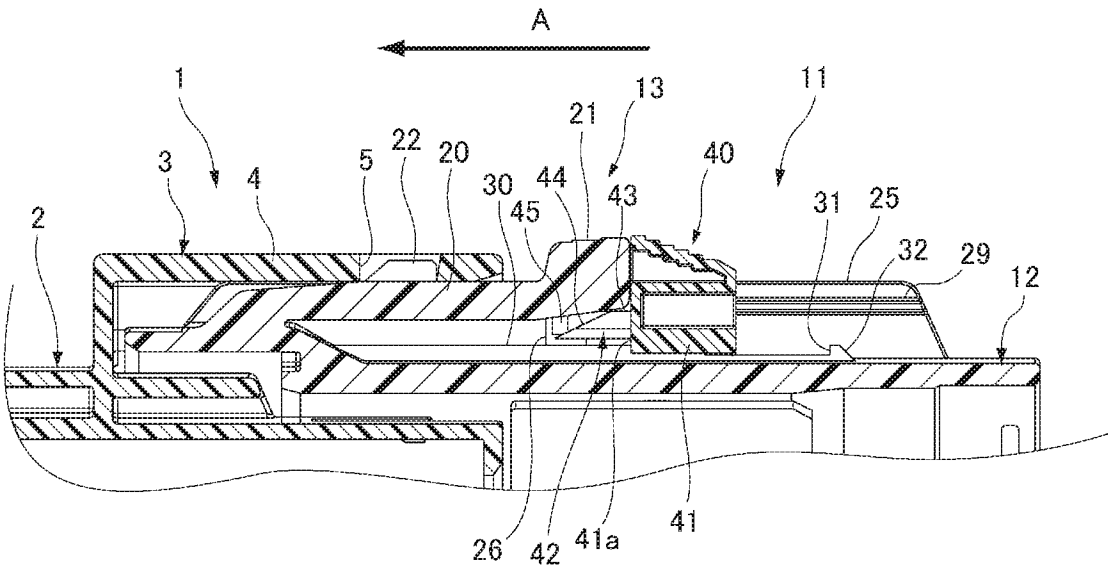
FIG. 7 is a sectional view of the slider in the slide direction when the slider on the connector fitted into the mating side connector is disposed at a main locking position.

When the slider 40 at the temporary locking position is pushed in toward the fitting direction A, the guide surface 47 of the locking arm 45 slides on an edge of the temporary locking hole 27, so that the locking arm 45 is elastically deformed inward, and the locking of the temporary locking hole 27 by the locking claw 46 is released. Accordingly, the slider 40 is moved from the temporary locking position to the fitting direction A. Then, as shown in FIG. 7, when the locking claw 46 of the locking arm 45 of the slider 40 reaches the locking hole 26, the elastically deformed locking arm 45 is restored and the locking claw 46 enters the locking hole 26, and the locking hole 26 of the housing 12 is locked and movement of the slider 40 is regulated. In the slider 40, a locking position at which the locking arm 45 locks the locking hole 26 is set as a main locking position. The main locking position is a position on a bending end side where the locking arm 20 is pressed at the pressing portion 21, and when the slider 40 is disposed at the main locking position, the rear end of the locking arm 20 is abutted on the abutting surface 43 of the bending regulation portion 42 of the slider 40, and the bending of the locking arm 20 toward the housing 12 (bending in the lock release direction) is regulated. In this way, the slider 40 is slidably provided on the housing 12 between the main locking position and the temporary locking position deviating from the main locking position.

Next, a case where the connector 11 according to the present embodiment is joined to the mating side connector 1 will be described.

Figure 8A:
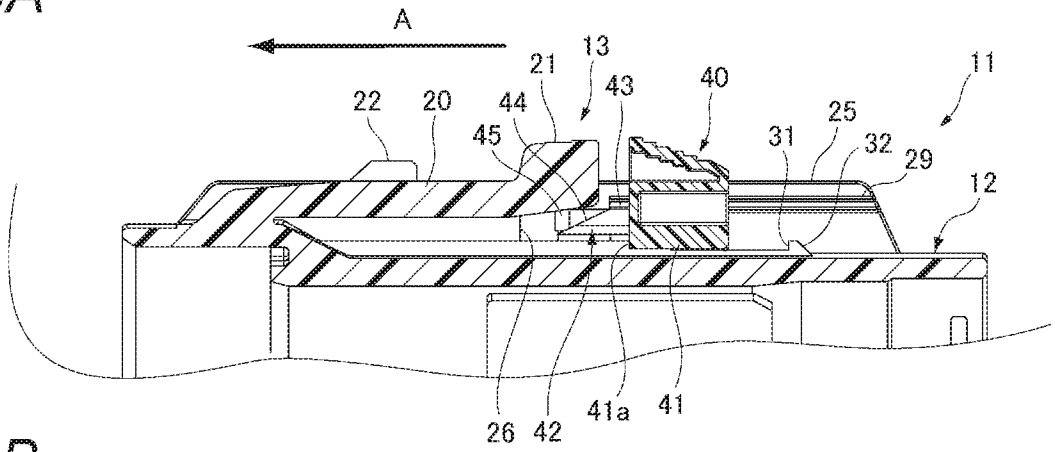
FIGS. 8A and 8B show push-back operation of the slider by a push-back inclined surface.
Figure 8B:
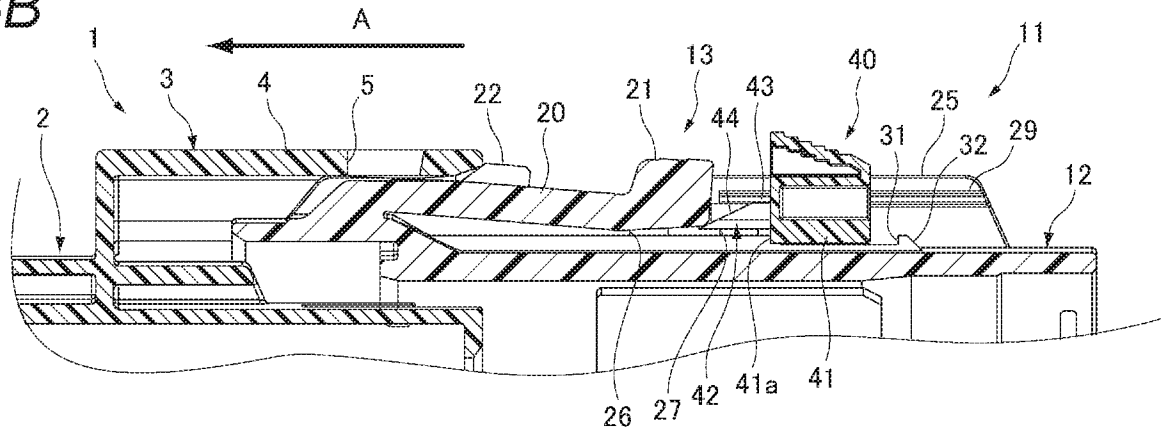

FIG. 7 is a sectional view of the slider 40 in the slide direction when the slider 40 on the connector 11 fitted into the mating side connector 1 is disposed at a main locking position. FIGS. 8A and 8B show push-back operation of the slider 40 by a push-back inclined surface 44, in which FIG. 8A is a sectional view in the slide direction of the slider 40 when the slider 40 is disposed at a position deviating from the temporary locking position, and FIG. 8B is a sectional view in the slide direction of the slider 40 when the slider 40 is pushed back in a direction away from the main locking position by the push-back inclined surface 44.

To join the connector 11 to the mating side connector 1, the connecting portion 12*a* of the housing 12 in which the slider 40 is disposed at the temporary locking position is brought close to the fitting portion 2*a* of the mating side housing 2, and the connecting portion 12*a* is fitted into the fitting portion 2*a*. Then, the mating side connector 1 and the connector 11 are joined, and the terminals provided on the housing 12 and the mating side housing 2 are electrically connected to each other. At this time, since the lock mechanism 13 enters the fitting engagement portion 3 of the mating side housing 2, the locking claw 22 of the locking arm 20 abuts on an edge of the top plate portion 4 of the fitting engagement portion 3 and enters an inside of the top plate portion 4. Accordingly, the locking arm 20 is pressed toward the housing 12 to be elastically deformed and bent. Since the housing 12 is fitted into the mating side housing 2, the elastically deformed locking arm 20 temporarily bends in the lock release direction, and then the locking claw 22 enters the engagement hole 5 of the top plate portion 4 to be restored. Accordingly, as shown in FIG. 6, the locking claw 22 of the locking arm 20 is engaged with the engagement hole 5 formed on the fitting engagement portion 3 of the mating side housing 2, and the mating side housing 2 and the housing 12 are locked with each other in a fitting state.

In the fitting state between the mating side housing 2 and the housing 12, when the pressing portion 21 provided at a rear end of the locking arm 20 is pressed, the locking arm 20 bends toward the housing 12, and the locking claw 22 of the locking arm 20 is pulled out from the engagement hole 5 of the fitting engagement portion 3, engagement between the engagement hole 5 of the fitting engagement portion 3 and the locking claw 22 of the locking arm 20 is released. That is, when the pressing portion 21 of the locking arm 20 is pressed and the housing 12 is pulled apart from the mating side housing 2, joining between the mating side connector 1 and the connector 11 is released.

In the fitting state between the mating side housing 2 and the housing 12, the slider 40 disposed at the temporary locking position is moved to the main locking position on the fitting direction A side with the mating side housing 2. Then, as shown in FIG. 7, the bending regulation portion 42 of the slider 40 enters between the rear end of the locking arm 20 and the housing 12 at the bending end side of the locking arm 20 in the lock release direction. Accordingly, even though the pressing portion 21 provided at the rear end of the locking arm 20 is pressed, the locking arm 20 is abutted on the abutting surface 43 of the bending regulation portion 42 of the slider 40, so that the locking arm 20 is regulated from bending toward the housing 12 (bending in the lock release direction). Therefore, the fitting state between the mating side housing 2 and the housing 12 is reliably maintained by the connector position assurance mechanism due to the slider 40.

As shown in FIG. 8A, when the slider 40 at the temporary locking position is unintentionally pushed toward the main locking position before the housing 12 is fitted into the mating side housing 2, the locking of the temporary locking hole 27 by the locking claw 46 may be released, and the slider 40 may deviate from the temporary locking position and move toward the main locking position. In this way, when the slider 40 deviates from the temporary locking position and moves toward the main locking position, an operator may perform fitting work of the housing 12 on the mating side housing 2 without noticing that the slider 40 deviates from the temporary locking position.

In such a case, in the connector 11 according to the present embodiment, when the housing 12 is fitted into the mating side housing 2, the locking claw 22 of the locking arm 20 abuts on the edge of the top plate portion 4 of the fitting engagement portion 3, so that the locking arm 20 is pressed toward the housing 12 and bent. Then, since the rear end of the locking arm 20 bending toward the housing 12 is in contact with the push-back inclined surface 44 of the slider 40, force toward the rear side of the housing 12, which is component force of the pressing force in the bending direction of the locking arm 20, is applied to the slider 40, and is pushed back in a direction away from the main locking position. Therefore, the housing 12 is smoothly fitted into the mating side housing 2 without regulating the bending of the locking arm 20 by the slider 40.

When the slider 40 deviating from the temporary locking position is disposed at the main locking position, the operator can visually recognize that the slider 40 is moved to the main locking position before the fitting work since the slider 40 moves largely. Therefore, in this case, the operator pushes the locking claw 46 of the locking arm 45 of the slider 40 in by using a tool or the like to remove it from the main locking hole 26, returns the slider 40 to the temporary locking position, and then performs the fitting operation.

As described above, according to the connector 11 according to the present embodiment, when the slider 40 is slid from the temporary locking position to the main locking position when the housing 12 is fitted into the mating side housing 2, the bending of the locking arm 20 is regulated by the slider 40. Therefore, the fitting state between the mating side housing 2 and the housing 12 is reliably maintained by the slider 40.

Further, when the housing 12 is fitted into the mating side housing 2 in a state in which the slider 40 deviates from the temporary locking position and moves toward the main locking position, the locking arm 20 bends, so that the slider 40 is pushed back in a direction away from the main locking position by the push-back inclined surface 44.

Therefore, even when the slider 40 moves from the temporary locking position toward the main locking position unintentionally, it is possible to reduce such a malfunction that the bending of the locking arm 20 is regulated by the slider 40 and the fitting work cannot be done, and such a malfunction that the locking claw 22 of the locking arm 20 and the engagement hole 5 formed on the fitting engagement portion 3 of the mating side housing 2 are damaged.

That is, it is possible to smoothly function the connector position assurance mechanism by the slider 40 while reducing the increase in cost by providing a mechanism on the mating side housing 2, and the mechanism pushes back the slider 40 disposed at a position away from the temporary locking position before fitting the mating side housing 2 with the housing 12.

Further, according to the connector 11 according to the present embodiment, when the slider 40 is disposed at the main locking position when the housing 12 is fitted into the mating side housing 2, the locking arm 20 is abutted on the abutting surface 43 to regulate the bending. Therefore, the fitting state between the mating side housing 2 and the housing 12 is reliably maintained by the slider 40.

Further, according to the connector 11 according to the present embodiment, since the slider 40 is locked at the main locking position by locking the locking arm 45 to the locking hole 26 of the housing 12, the fitting state between the mating side housing 2 and the housing 12 by the slider 40 can be further reliably maintained. Further, since the slider 40 is locked at the temporary locking position by locking the locking arm 45 to the temporary locking hole 27 of the housing 12, it is possible to prevent the slider 40 from being moved toward the main locking position before the fitting between the mating side housing 2 and the housing 12.

The present invention is not limited to the above embodiment, and modifications, improvements, and the like can be made as appropriate. In addition, the material, shape, size, number, arrangement position and the like of each component in the above-described embodiment are optional and are not limited as long as the invention can be achieved.

For example, in the above embodiment, the push-back inclined surface 44, which pushes back the slider 40 in the direction away from the main locking position since the locking arm 20 bends in the lock release direction, is provided on the slider 40 side, but the push-back inclined surface is not limited to be provided on the slider 40, but may be provided on the locking arm 20 or on both the slider 40 and the locking arm 20.

Here, characteristics of the embodiment of the connector according to the present invention described above are briefly summarized and listed in the following [1] to [3] respectively.

[1] A connector comprising:

a housing (12) fitted into a mating side housing (2);

a locking arm (20) including a locking portion (locking claw 22); and a slider (40), wherein the locking arm (20) is connected to the housing (12) and extends toward a rear end and along a fitting direction (A) into the mating side housing (2), wherein the locking arm (20) is configured to be restored after bending in a lock release direction and the locking portion (22) is configured to be engaged with an engagement portion (engagement hole 5) of the mating side housing (2) to lock the mating side housing (2) and the housing (12) in a fitting state, when the housing (12) is being fitted into the mating side housing (2), wherein a slider (40) is slidably provided on the housing (12) between a main locking position on a bending end side of the locking arm (20) and a temporary locking position deviating from the main locking position, wherein the slider (40) is configured to be moved from the temporary locking position to the main locking position, so as to regulate bending of the locking arm (20) in the lock release direction, wherein at least one of the slider (40) and the locking arm (20) includes a push-back inclined surface (44) inclined in a side of the main locking position and toward a bending direction in the lock release direction of the locking arm (20), and wherein when the slider (40) is disposed at a position deviating from the temporary locking position, the locking arm (20) is bent in the lock release direction and is in contact with the slider (40), and the slider (40) is pushed back in a direction away from the main locking position by the push-back inclined surface (44).

[2] The connector (11) according to the above [1], wherein the slider (40) includes an abutting surface (43) orthogonal to the bending direction of the locking arm (20), and wherein the locking arm (20) is abutted on the abutting surface (43) of the slider (40) disposed at the main locking position so as to regulate bending in the lock release direction.

[3] The connector (11) according to the above [1] to [2], wherein a main locking portion (locking hole 26) that locks the slider (40) at the main locking position and a temporary locking portion (temporary locking hole 27) that locks the slider (40) at the temporary locking position are disposed between the housing (12) and the slider (40).

DESCRIPTION OF REFERENCE NUMERALS AND SIGNS

2: Mating side housing

3: Fitting engagement portion

5: Engagement hole (Engagement portion)
11: Connector
12: Housing
20: Lock arm
22: Locking claw (Locking portion)
26: Locking hole (Locking portion)
27: Temporary locking hole (Temporary main locking portion)
40: Slider
43: Abutment surface
44: Push-back inclined surface
A: Fitting direction

What is claimed is:

1. A connector comprising:

a housing fitted into a mating side housing;

a locking arm including a locking portion; and a slider, wherein the locking arm is connected to the housing and extends toward a rear end and along a fitting direction into the mating side housing, wherein the locking arm is configured to be restored after bending in a lock release direction and the locking portion is configured to be engaged with an engagement portion of the mating side housing to lock the mating side housing and the housing, when the housing is being fitted into the mating side housing, wherein the slider is slidably attached to the housing between a main locking position on a bending end side of the locking arm and a temporary locking position deviating from the main locking position, wherein the slider is configured to be moved from the temporary locking position to the main locking position, so as to regulate bending of the locking arm in the lock release direction, wherein at least one of the slider and the locking arm includes a push-back inclined surface inclined in a main locking position side and toward a bending direction in the lock release direction of the locking arm, wherein the slider includes a slider body formed in a block shape, and a bending regulation portion is formed on a lower side of a front surface of the slider body, wherein when the slider is disposed at a position deviating from the temporary locking position, the locking arm is bent in the lock release direction and is in contact with the slider, and thereby the slider is pushed back in a direction away from the main locking position by the push-back inclined surface formed on an upper side of a front side of an abutting surface, the abutting surface being formed on the bending regulation portion and being orthogonal to a bending direction of the locking arm, and wherein the slider body includes a pair of side walls, a guide recess on an underside of the slider body that faces the housing, and a locking protrusion formed on the guide recess on a rear end side of the slider body, the guide recess is between the side walls, the locking protrusion protrudes toward the housing and is spaced away from each of the side walls.

2. The connector according to claim 1, wherein the locking arm is configured to be abutted on the abutting surface of the slider disposed at the main locking position, so as to regulate bending in the lock release direction.

3. The connector according to claim 1, wherein a main locking portion locking the slider at the main locking position and a temporary locking portion locking the slider at the temporary locking position are disposed between the housing and the slider.

4. The connector according to claim 1, wherein a temporary locking hole is formed in a rear position in the fitting direction with respect to a locking hole.

5. The connector according to claim 4, wherein the slider further comprises a locking arm having a locking claw that enters the temporary locking hole at the temporary locking position.

6. The connector according to claim 5, wherein the locking claw enters the locking hole at the main locking position.

7. The connector according to claim 6, wherein when the slider at the temporary locking position is pushed in toward the fitting direction, the locking arm slides on an edge of the temporary locking hole, so that the locking arm is elastically deformed inward, and the locking of the temporary locking hole by the locking claw is released.

8. The connector according to claim 1, wherein the slider further comprises guide grooves, the housing further comprises guide rail portions, and the guide rail portions are engaged with the guide grooves such that the slider is supported by the housing to be slidable within a moveable range.

9. The connector according to claim 1, wherein a pressing portion of the locking arm is abutted on the slider at the main locking position so as to regulate bending in the lock release direction.

10. The connector according to claim 1, wherein the housing includes a protruding wall, and wherein the locking protrusion is spaced away from the protruding wall when the slider is in the main locking position and the locking protrusion is adjacent to the protruding wall when the slider is in the temporary locking position.

* * * * *